United States Patent [19]

Tacke

[11] 3,937,434

[45] Feb. 10, 1976

[54] WIRE ROD CHAIR BASE

[75] Inventor: William H. Tacke, Wyoming, Mich.

[73] Assignee: Curtis Products Ltd., Cobourg, Canada

[22] Filed: June 20, 1974

[21] Appl. No.: 481,129

[52] U.S. Cl. ..... 248/188.7

[51] Int. Cl.[2] ..... A47C 7

[58] Field of Search ..... 248/188.7, 188.1, 44, 175, 248/163; 247/349

[56] References Cited

UNITED STATES PATENTS

| | | | |
|---|---|---|---|
| 2,476,258 | 7/1949 | Lundquist | 248/188.7 X |
| 2,849,202 | 8/1958 | McCombs | 248/44 |
| 2,919,878 | 1/1960 | Nathan | 248/188.7 |
| 2,992,803 | 7/1961 | Good | 248/188.7 |
| 3,390,421 | 7/1968 | Sullivan | 248/188.7 X |
| 3,787,018 | 1/1974 | Nathan | 248/188.7 |
| 3,838,838 | 10/1974 | Seaman | 248/188.7 X |

FOREIGN PATENTS OR APPLICATIONS

| | | | |
|---|---|---|---|
| 1,153,498 | 8/1963 | Germany | 248/188.1 |

*Primary Examiner*—Roy D. Frazier
*Assistant Examiner*—Robert W. Gibson, Jr.
*Attorney, Agent, or Firm*—Price, Heneveld, Huizenga & Cooper

[57] ABSTRACT

A chair base utilizing a hub assembly supported by wire rod sets extending laterally outward from the hub and secured in caster sockets at their outer ends.

10 Claims, 9 Drawing Figures

WIRE ROD CHAIR BASE

BACKGROUND OF THE INVENTION

The present invention relates to chair bases and particularly to pedestal type chair bases in which a hub assembly is supported by a plurality of legs extending radially outwardly therefrom. Typically, casters or glides are positioned in the ends of these radially outwardly extending legs.

The outwardly extending legs in such bases are typically made of tubular steel of a generally rectangular lateral cross section. The prior art patent to Schachtel U.S. Pat. No. 2,044,021 does disclose a base using tubes of a generally circular cross section. The loads placed on the legs in such bases are extremely severe and accordingly, strength is a very significant factor.

To my knowledge, no one has heretofore made a pedestal type chair base employing wire rods. To be sure, chair legs have been made of wire rod, but such legs have been of the type found on stacking chairs wherein the wire rod extends straight down from the bottom of the chair seat generally at each of the four corners thereof. Wire rod has also been used to define outwardly extending wire legs on such prior art devices as display stands or Christmas tree stands. However, no prior art wire rod structure has been devised which is sufficiently strong to serve as a pedestal type base for chairs where the loads imposed are quite heavy.

OBJECTS AND SUMMARY OF THE INVENTION

The present invention comprises a pedestal type wire rod chair base which is strong enough to withstand the loads imposed on the radially outwardly extending wire sets which define the legs of the base. Each of the plurality of wire rod sets which extends outwardly from the hub assembly includes a first wire rod extending outwardly from generally the bottom of the hub assembly and a second wire rod extending generally diagonally outwardly and downwardly from the hub assembly at a point located above the first rod. The two rods are then secured together at their ends in a caster socket assembly.

Preferably, the hub assembly comprises an inner and an outer tube and the upper diagonally extending wire rod actually extends through an aperture in the outer tube and bears against the inner tube. In another aspect of the invention, the caster socket assembly includes an elongated slot, open through the bottom of the assembly, in which the ends of the wire rod are joined in adjacent, side-by-side relationship for convenient welding across the bottom of the caster assembly.

These and other objects, features and advantages of the invention will be more fully understood and appreciated by reference to the written specification and appended drawings.

DESCRIPTION OF THE PREFERRED EMBODIMENTS

Figure 1:
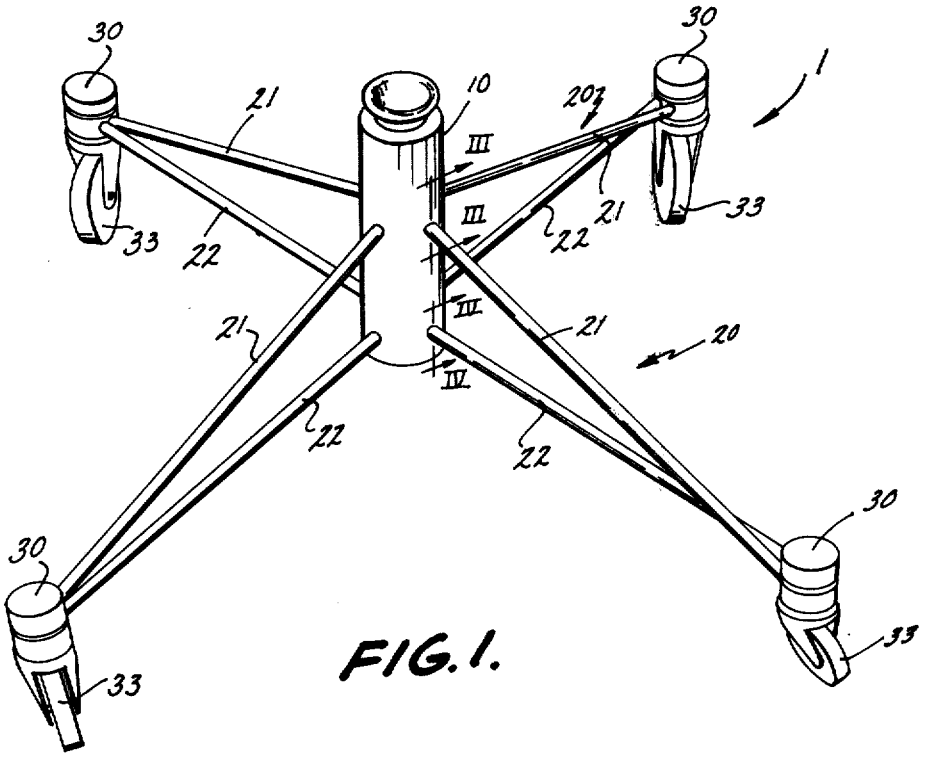
FIG. 1 is a perspective view of the wire rod chair base.

Referring to the drawings and specifically to FIG. 1, wire rod chair base 1 includes a hub assembly 10 which is supported by wire rod support sets 20 which in turn are secured to caster socket assemblies 30. As is readily apparent in FIG. 1, casters 33 or the like may be mounted onto caster socket assembly 30 so as to provide mobile floor mounts for chair base 1.

Figure 2:
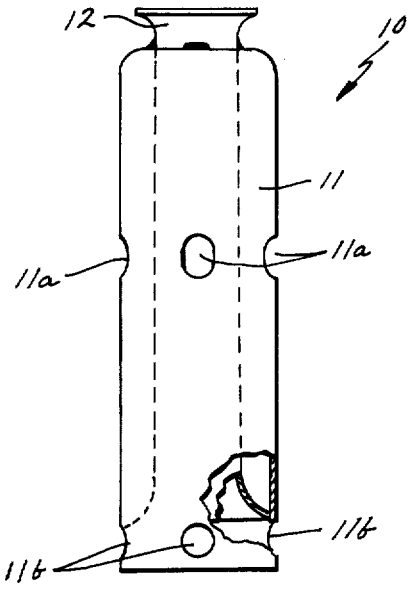
FIG. 2 is a side elevational view of the hub assembly detached from the chair base of FIG. 1 with a partial vertical cross section therein.

Hub assembly 10 is shown in FIG. 2 and includes a cylindrical inner or hub tube 12 and an outer tube 11 which acts to surround and mask inner tube 12. Inner tube 12 includes a flattened portion at the top and is capable of receiving a chair or the like and acting as a mounting pedestal or spindle bearing tube for the chair. The bottom portion of inner tube 12 is similarly broadened as is the top portion of the tube so as to engage the inner wall of outer tube 11.

Outer tube 11 is generally cylindrical in shape and comprises four equally spaced sets of holes 11*a* and 11*b*. Holes 11*a* are slightly above the middle of the tube, while corresponding cylindrical holes 11*b* along the bottom of the tube. As shown in FIG. 2, inner tube 12 is rigidly secured to and is held in spaced relation within order tube 11 by welds at its top portion and by welds at its lower portion. Of course, other suitable means besides welds may be used to secure inner tube 12 within outer tube 11.

Referring back to FIG. 1, each wire rod support set 20 includes an upper rod 21 and a slightly shorter lower rod 22. The rods 21 and 22 may be made of any number of conventional rod materials and may also be painted or metallic plated so as to improve their appearance. The rods are made of sufficiently strong material so as to enable them to support the weight of a chair and the occupant thereof attached to base 1.

Figure 3:
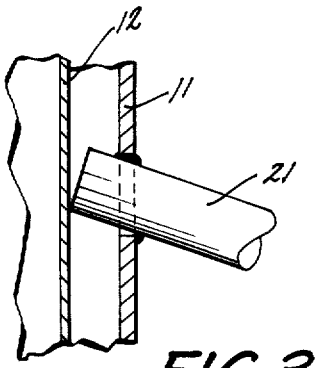
FIG. 3 is a partial cross-sectional view of the chair base taken along plane III—III of FIG. 1.
Figure 4:
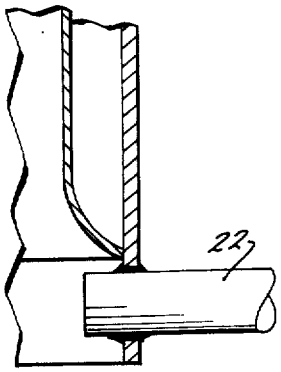
FIG. 4 is a partial cross-sectional view of the chair base taken along plane IV—IV of FIG. 1.

As shown in FIGS. 1, 3, and 4, wire rods 21 and 22 extend into and are rigidly attached to hub assembly 10. Specifically, each lower rod 22 is inserted through outer tube 11*b* and fixedly attached to outer tube 11 and inner tube 12 by welds or other suitable means.

Each upper rod 21 extends through holes 11*a* in outer tube 11 and abuts or bears against inner tube 12. Rod 21 is fixedly attached to outer tube 11 also be welds. As is apparent in FIG. 3, the edge of rod 21 bears against or abuts inner tube 12 so that as weight is applied to inner tube 12 by a chair and its occupant, rod 21 acts to brace against inner tube 12.

Figure 8:
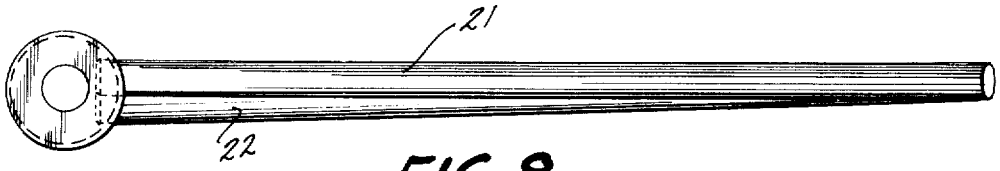
FIG. 8 is a top plan view of the wire rod set and caster socket assembly of FIG. 7.
Figure 5:
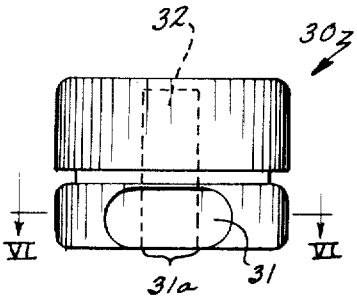
FIG. 5 is an elevational view of the caster socket assembly detached from the chair base of FIG. 1.
Figure 6:
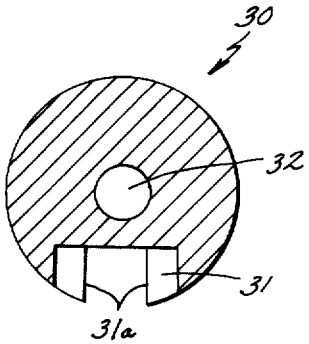
FIG. 6 is a cross-sectional view of the caster socket assembly taken along plane VI—VI of FIG. 5.

Caster socket assemblies 30 in FIGS. 1, 5–8 and 9 are generally circular in shape and each includes slotted portion 31 and aperture 32 therein. Slotted portion 31 as seen in FIG. 5 is elongated in shape and extends horizontally about a third of the way through caster socket assembly 30 (FIG. 6). Slot 31 is capable of receiving rods 21 and 22 in a side by side arrangement (FIG. 8). Aperture 32 extends vertically upward from the bottom of housing 30 and is circular in shape; however, it does not extend completely through the top of the housing. Thus, aperture 32 is capable of slidably receiving and securing casters therein as in FIG. 1 or other suitable floor mounts as desired.

Figure 7:
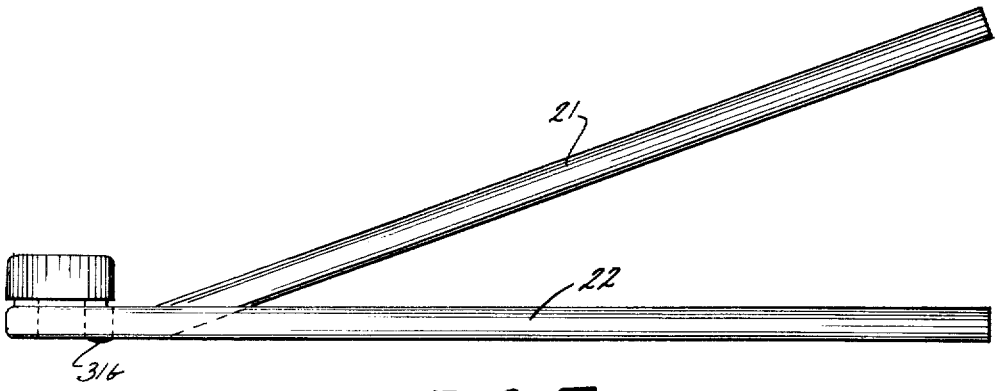
FIG. 7 is a side elevational view of each wire rod set joined with a caster socket assembly as detached from the chair base of FIG. 1.

As is best shown in FIGS. 1, 7, and 8, each upper rod 21 and each lower rod 22 is inserted into slot 31 and may be fixedly attached therein by conventional means as desired, i.e., welding, screws etc. As is readily apparent in the figures, the lower portion of upper rod 21 is bent so as to horizontally extend into slot 31 so that caster socket housing 30 may be generally parallel to lower rod 22 maintaining the horizontal plane of caster socket housing 30 in general parallel alignment with lower rod 22.

Slot 31 in caster socket is horizontally elongated so that the ends of wire rods 21 and 22 fit thereinto in side by side relationship. Also, slot 31 is open at its bottom at opening 31*a*. Opening 31*a* is narrower in width than the combined width of rods 21 and 22 placed side by side so that they cannot slip out through opening 31*a* during assembly. However, opening 31*a* is sufficiently large, about three-eighths of an inch, that the juncture of abutting rods 21 and 22 is accessible for welding. In assembly, a weld 31*b* is run across the bottom of caster socket 30 at opening 31*a* to hold the ends of rods 21 and 22 in caster socket 30 and to hold them together (FIG. 7).

Figure 9:
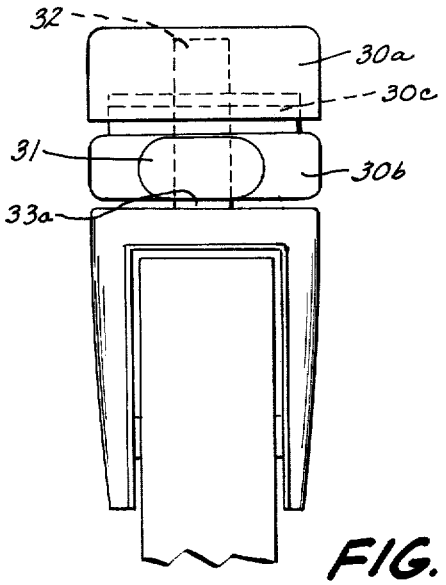
FIG. 9 is a side elevational view of an alternate embodiment of the caster socket assembly of the chair base.

In the alternate embodiment of the caster socket assembly 30 shown in FIG. 9, assembly 30 is formed of an upper portion 30*a* threaded onto a lower portion 30*b* by thread portion 30*c* therebetween. Lower portion 30*b* comprises the above described horizontal slotted portion 31 into which are fitted upper and lower rods, 21 and 22. Both upper portion 30*a* and lower portion of caster socket housing 30 include vertical slot 32 for slidable insertion of casters 33 or the like which include caster pintles 33*a* which is in internal contact with the top of upper portion 30*a*. When it is desired to level chair base 1, each caster socket assembly 30 may have upper housing 30*a* rotated upward or downward so as to adjust the height of the caster 33 with respect to lower housing 30*a* and thus rods 21 and 22 inserted therein. Thus, providing a means for leveling base 1.

As is readily apparent in the above description, chair base 1 of the present invention may comprise as many wire rod support sets 20 used in conjunction with hub assembly 10 and caster assemblies 30 as desired. In the embodiment shown, however, four wire rod support sets are preferred.

OPERATION

A chair or the like may be attached to chair base 1 by insertion or otherwise appropriate mounting of the chair onto inner tube 12 of hub assembly 10. When weight is placed onto the chair or the like, compressive forces are exerted against upper rod 21 by inner tube 12 which in turn exerts force against caster assembly 30. Leg assembly 30 correspondingly is forced outward and pulls lower rod 22 so as to exert tension force thereon. By this combination of compressive and tensive forces on the wire rods 21 and 22, hub 10 is supported in spaced relation between caster socket assemblies 30 and acts to support the chair inserted therein.

It will be understood that various changes in the details, materials, steps, and arrangements of parts which have been herein described and illustrated in order to explain the nature of the invention, may be made by those skilled in the art within the principle and the scope of the invention as expressed in the appended claims.

The embodiments of the invention in which an exclusive property or privilege is claimed are defined as follows:

1. A wire rod pedestal type chair base comprising:
a hub assembly; and
a plurality of wire rod support sets supporting said hub assembly, each set including a first rod element attached at one end to and extending laterally and generally horizontally outward from said hub assembly and a second rod element attached at one end to a portion of said assembly above the point at which the first rod is attached and extending diagonally downward therefrom;
a caster socket assembly for each wire rod set secured to the other ends of said first and second wire rods for receiving casters whereby said base rests on the floor; said hub assembly including an inner tube and an outer tube which masks said inner tube, said first rod element extending through and being rigidly attached to said outer tube and said second rod element extending through and being secured to said outer tube, and abutting against said inner tube to provide support.

2. The wire rod chair base of claim 1 further including a means for rigidly and securedly adjoining said first and second rod elements along a portion thereof remote from said hub.

3. The wire rod chair base of claim 1 wherein said chair base includes four wire rod support sets.

4. A wire rod pedestal type chair base comprising:
a hub assembly; and
a plurality of wire rod support sets supporting said hub assembly, each set including a first rod element attached at one end to and extending laterally and generally horizontally outward from said hub assembly and a second rod element attached at one end to a portion of said assembly above the point at which the first rod is attached and extending diagonally downward therefrom;
a caster socket assembly for each wire rod set secured to the other ends of said first and second wire rods for receiving casters whereby said base rests on the floor;
means for rigidly and securedly adjoining said first and second rod elements along a portion thereof remote from said hub; said means for joining and rigidly securing said first and second rod elements comprises said caster socket assembly, said caster socket assembly including a slotted portion capable to receiving the said ends of said first and second rod elements therein.

5. The wire rod chair base of claim 4 in which said slotted portion of said caster socket comprises a horizontally elongated slot, said ends of said first and second rod elements being positioned within said slot in a horizontally adjacent relationship; said slot being positioned near the bottom of said caster socket and including an opening through the bottom of said caster socket whereby said ends of said first and second rod elements can be secured to one another and to said caster socket by weld means on the bottom of said caster socket extending across said opening.

6. A wire rod, pedestal type chair base comprising: a hub assembly; a plurality of wire rod support sets supporting said hub assembly, each set including a first rod attached at one end to said hub assembly and extending laterally and generally horizontally outwardly from said hub assembly and a second rod attached at one end to said hub assembly at a point above said first rod and extending generally diagonally downwardly and outwardly therefrom; a caster socket assembly for each wire rod set including an elongated slot therein, the ends of each of said first and second wire rods being mounted immediately adjacent one another in said elongated slot.

7. The wire rod chair base of claim 6 in which said elongated slot is oriented generally horizontally so that said ends of said first and second wire rods are positioned horizontally adjacent one another; said slot being located generally adjacent the bottom of said caster socket and including an opening downwardly through the bottom of said caster socket; weld means on the bottom of said caster socket extending across said opening whereby said ends of said first and second wire rods are secured to said caster socket and to each other.

8. The wire rod chair base of claim 7 in which said opening is narrower in width than the width of both of said horizontally adjacent ends of said first and second wire rod but is sufficiently large that the juncture between said adjacent ends of said first and second wire rods is readily accessible to said weld means.

9. A wire rod chair base comprising:

a hub assembly;

a plurality of wire rod support sets, each wire rod support set including a first rod element attached to and extending laterally and generally horizontally outward from a lower portion of said hub assembly and a second rod element attached to a higher portion of said hub assembly and extending diagonally downward therefrom; a caster socket means for adjoining and rigidly securing said first and second rod elements at their outer end portions from said hub assembly, said caster socket means further including adjustment means thereon for selectively raising and lowering a caster mounted therein relative to said ends of said rod elements; said caster socket means for adjoining and rigidly securing said wire rod elements at their outer end includes portions from said spindle upper and lower housings, said housings including a threaded portion therebetween to allow relative up and down movement of said housings with respect to each other, said lower housings including a slotted portion capable of receiving said first and second rod elements therein, and both of said portions including an aperture therein for slidably receiving casters of the like said aperture only partially extending through said upper housing and the top of the caster pintle engaging the top of said upper housing whereby when it is desired to raise and lower said rod elements with respect to said casters, said upper housing may be displaced with respect to the lower housing by rotating the upper housing with respect to the lower housing along the threaded portion therebetween so as to raise and lower said rod elements with respect to the casters.

10. The wire rod chair base of claim 9 wherein said hub assembly includes an inner tub and an outer tube which masks said inner tube, said first rod element extending through and being rigidly attached to said outer tube and said second rod element extending through and being secured to said outer tube and abutting against said inner tube to provide support.

* * * * *

UNITED STATES PATENT AND TRADEMARK OFFICE

CERTIFICATE OF CORRECTION

PATENT NO. : 3,937,434

DATED : February 10, 1976

INVENTOR(S) : William H. Tacke

It is certified that error appears in the above-identified patent and that said Letters Patent are hereby corrected as shown below:

Column 2, Line 58:

"be" should be ---by---;

Column 4, Line 54:

"to" should be ---of---.

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*